US005150493A

United States Patent [19]

Sivacoe

[11] Patent Number: 5,150,493

[45] Date of Patent: Sep. 29, 1992

[54] PIPELINE PIG

[76] Inventor: Orlande Sivacoe, 4700 - 55 Street, #601, Red Deer, Alberta, Canada, T4N 2H8

[21] Appl. No.: 674,386

[22] Filed: Mar. 25, 1991

[51] Int. Cl.[5] ..... B08B 9/04

[52] U.S. Cl. ..... 15/104.061

[58] Field of Search ..... 15/104.061, 104.063, 15/3.5, 3.51; 134/8

[56] References Cited

U.S. PATENT DOCUMENTS 4,242,771 1/1981 Knapp ..... 15/104.061
4,244,073 1/1981 Sagawa ..... 15/104.061
4,825,498 5/1989 Rankin ..... 15/104.061

*Primary Examiner*—Edward L. Roberts
*Attorney, Agent, or Firm*—George A. Seaby

[57] ABSTRACT

Pipe cleaning pigs have a relatively short life expectancy and are ill adapted for cleaning any deposits harder than candle wax. A relatively simple solution to these problems involves a pipe cleaning pig including an elongated, one-piece, flexible, cylindrical body with hemispherical ends annular ribs integral with and extending outwardly from the body, longitudinal ribs extending between the annular ribs for strengthening the annular ribs and defining recesses with such annular ribs, and teeth in the recesses for engaging the interior of a pipe when the pig is moved through the pipe under fluid pressure.

5 Claims, 3 Drawing Sheets

PIPELINE PIG

BACKGROUND OF THE INVENTION

1. FIELD OF THE INVENTION

This invention relates to a pig for cleaning a pipe or pipeline.

For the sake of simplicity, in the following, the term "pipeline" is used to describe a conventional pipeline or pipes used to convey fluids, e.g. in industrial heaters or cooling systems.

2. DISCUSSIONS OF THE PRIOR ART

Pipelines are commonly used to transport, inter alia, crude oil, gas, slurries or water. During use, the interior of a pipeline becomes coated which decreases flow through the pipeline. Typical coatings include paraffin, asphaltene, sediments, silica, coke, calcium or other salts and corrosion products which are often difficult or almost impossible to remove. The standard method of cleaning a pipeline is to drive a so-called pig through the pipeline using fluid pressure as the driving force. Pigs can also be used as dividers when transporting different materials through the pipeline, the pig simultaneously cleaning the interior of the pipeline.

Examples of pipeline cleaning pigs are described in U.S. Pat. Nos. 2,447,966, issued to D. K. Stephens on Aug. 24, 1948; 3,204,274, issued to M. M. Knapp on Sep. 7, 1965; 3,277,508, issued to M. M. Knapp et al on Oct. 1, 1968; 3,389,417, issued to M. M. Knapp et al on Jun. 25, 1968; 3,538,531, issued to M. M. Knapp et al on Nov. 10, 1970; 3,605,159, issued to H. J. Girard on Sep. 20, 1971; 3,659,305, issued to M. D. Powers on May 2, 1972; 3,725,968, issued to M. M. Knapp et al on Apr. 10, 1973; 3,863,287, issued to K. M. Knapp et al on Feb. 4, 1975; 4,077,079, issued to M. M. Knapp on Mar. 7, 1978; 4,244,073, issued to S. Sagawa on Jan. 13, 1981; 4,509,222, issued to K. M. Knapp on Apr. 9, 1985 and 4,603,449, issued to K. M. Knapp on Aug. 5, 1986.

In general, many existing pipeline pigs are incapable of cleaning deposits much harder than candle wax. Those pigs which are adapted to clean hard deposits such as sediment and scale are not able to maintain a seal between separate products in a pipeline, and are prone to tearing on welds or other irregularities on the interior of the pipeline.

GENERAL DESCRIPTION OF THE INVENTION

An object of the present invention is to solve the above problems by providing a relatively simple pipe or pipeline pig, which can remove hard deposits from the interior of a pipeline.

Another object of the invention is to provide a pipeline pig which can maintain a seal between different products in a pipeline, i.e. the pig can be used to clean only or to clean a pipeline and simultaneously separate products in the pipeline.

Accordingly, the invention relates to a pig for use in a pipeline comprising one-piece, elongated, flexible, cylindrical body means; a plurality of annular rib means integral with said body means; longitudinal rib means integral with said body means extending between adjacent said annular rib means; and defining recesses with said annular rib means and tooth means extending out of said body means in each said recess, said tooth means and said rib means simultaneously engaging the interior of a pipeline when the pig is moved through the pipeline by a pressure differential in the pipeline.

BRIEF DESCRIPTION OF THE DRAWINGS

The invention will be described in greater detail with reference to the accompanying drawings, which illustrate a preferred embodiment of the invention, and wherein.

DESCRIPTION OF PREFERRED EMBODIMENT

Figure 1:
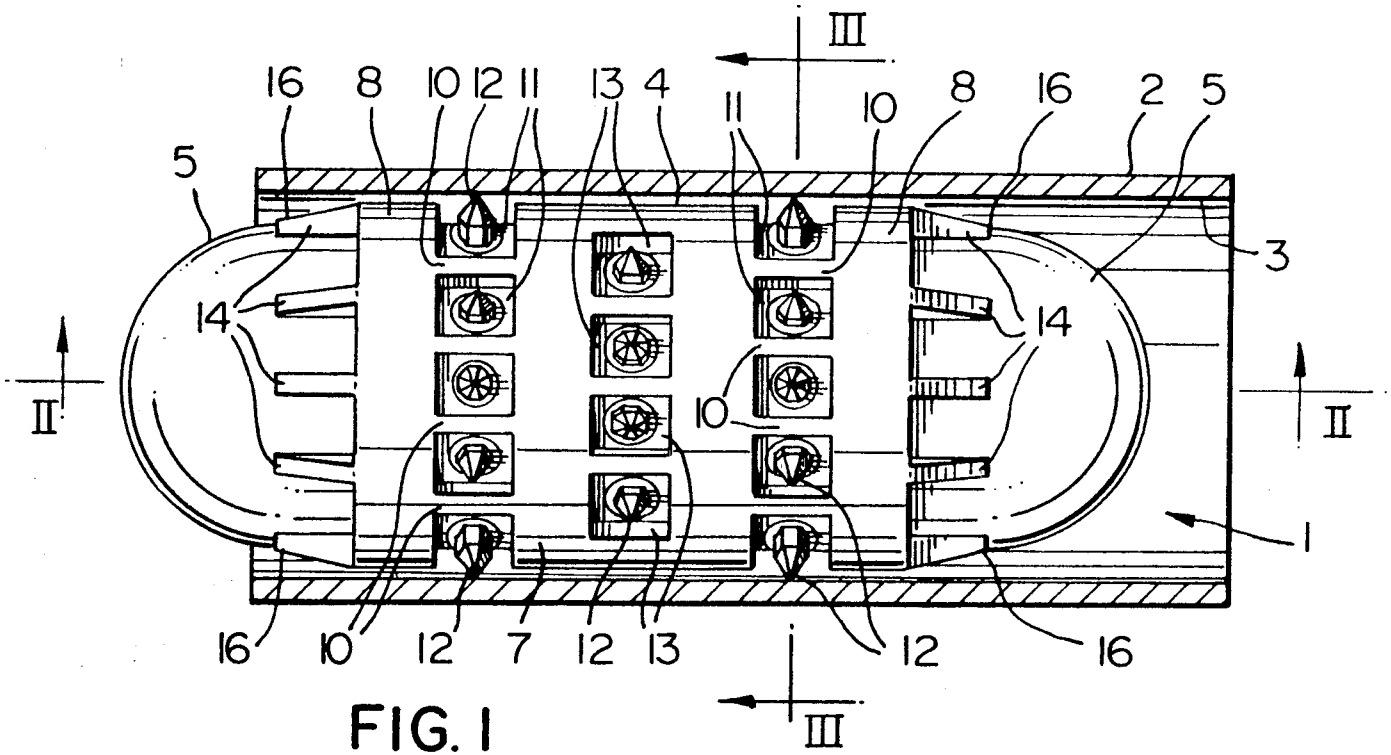
FIG. 1 is a side elevational view of a pig in accordance with the present invention in a section of pipeline.
Figure 2:
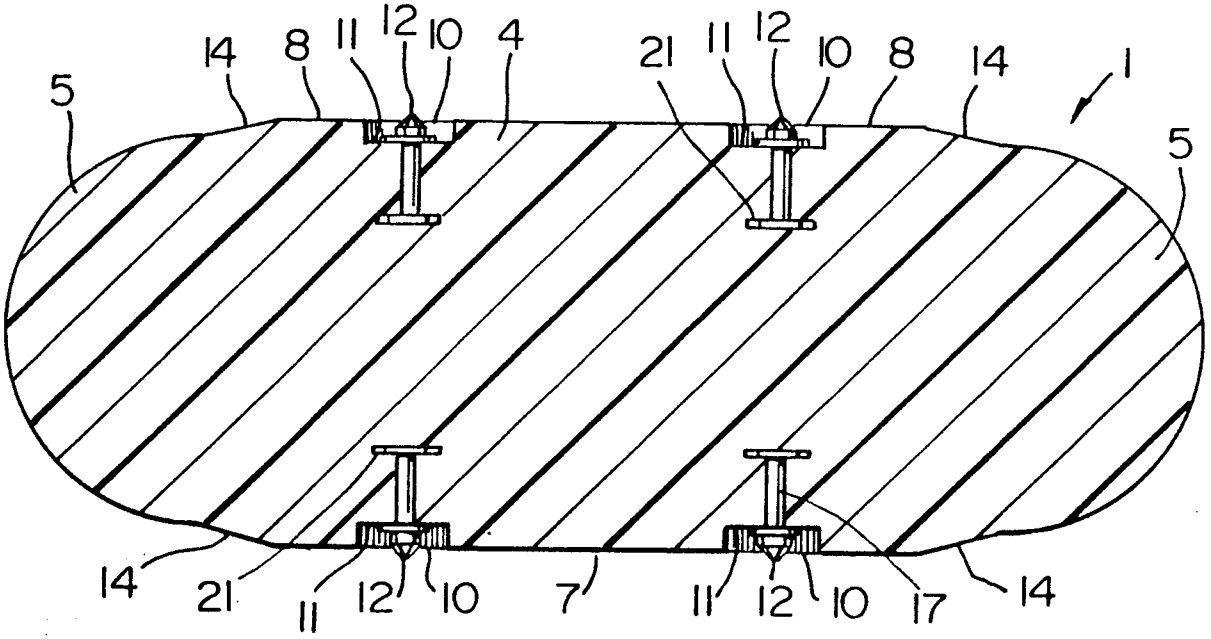
FIG. 2 is a longitudinal sectional view of the pig taken generally along line II—II of FIG. 1.
Figure 3:
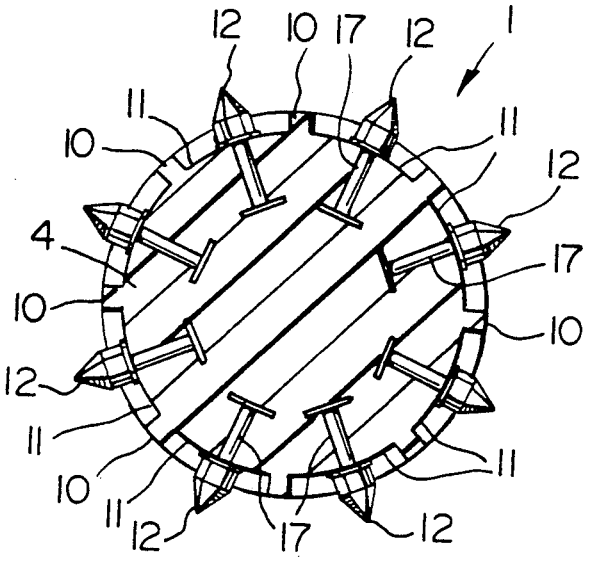
FIG. 3 is a cross section of the pig taken generally along line III—III of FIG. 1.
Figure 4:
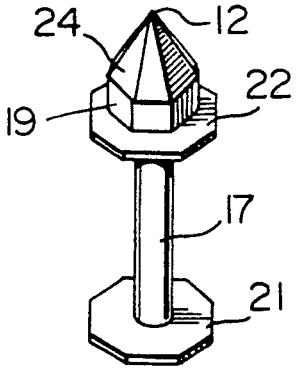
FIG. 4 is an isometric view of a tooth used in the pig of FIGS. 1 to 3.

Referring to FIGS. 1 to 3, the pig of the present invention which is generally indicated at 1 is intended for use in a pipeline, a section 2 of which is shown in FIG. 1 for cleaning the interior 3 thereof. The pig 1 includes a onepiece elongated, flexible, cylindrical body 4 with hemispherical ends 5. The body is symmetrical, permitting travel in both directions which is important when using the pig in industrial heaters and similar pipelines. The body 4 is formed, e.g. of polyethylene, polypropylene, rubber or polyurethane. The flexibility and hardness of the body 4 are adapted to the intended use.

A wide annular rib 7 is provided at the center of the body 4, and two narrower annular ribs 8 are provided nearer to the ends 5 of the body. Thin, longitudinal ribs 10 extend between the ribs 7 and 8. The annular ribs 7 and 8, and the longitudinal ribs 10 define the sides and ends of square recesses 11, each of which contains a tooth 12. Another circumferential row of recesses 13 is provided on each side of the central ribs 7 (only one row shown). Each of the recesses 13 also contains a tooth 12. Additional ribs or fingers 14 extend outwardly from the outer side edge of each end rib 8. The fingers 14 are spaced equidistant apart around the periphery of the body 4, and taper outwardly from a wide inner end having the same thickness as the ribs 7 and 8 to a narrow outer end 16 (FIG. 1). The fingers 14 lend strength to the ribs 8 in the longitudinal direction. The dimensions and numbers of ribs 7, 8 and 10 and fingers 14 may vary depending upon the use of the pig, e.g. the seal required for pig travel through the pipeline. Moreover, the ribs and fingers can be formed of different material and have a different hardness from each other and from the remainder of the body 4. For example, the use of harder end ribs 8 may be required because of the fact that the end ribs define the leading ribs in the direction of pig travel, and thus are subjected to higher forces than the rib 7.

Figure 5:
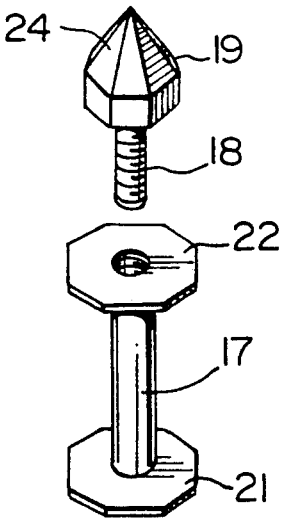
FIG. 5 is an exploded, isometric view of the tooth of FIG. 4.

Each tooth 12 includes an internally threaded anchor or sleeve 17 for mounting in the body 4, and a separate threaded shank 18 (FIG. 5) carrying a head 19 for mounting in the sleeve 17. The plates 21 and 22 may also be circular. Hexagonal flanges or plates 21 and 22 are provided on the bottom and top ends, respectively of the sleeve 17. The plate 21 anchors the sleeve 17 in the body 4, and the plate 22 limits movement of the sleeve into the body 4. The head 19 has a hexagonal base and a pyramidal pointed end 24. The sleeve 17, and the shank 18 and head 19 are formed of metal, but depending upon the intended use, can also be formed of plastic.

Figure 6:
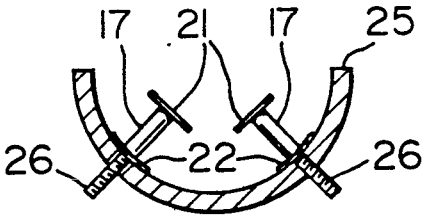
FIG. 6 is a cross-sectional view of a portion of a mold used to produce the pig of FIGS. 1 to 3.

With reference to FIG. 6, the sleeves 17 are molded into the body using a mold (not shown), each half 25 of which contains threaded holes for receiving threaded sleeve holders 26. The sleeves 17 are mounted on the holders 26 in the mold cavity before the mold is closed. The mold is closed, and the body 4 is molded. The mold is opened, the holders 26 are removed and the body 4 is removed from the mold. The shanks 18 are threaded into the sleeves 17 to complete the pig.

In use, the pig is inserted into a pipe, and is propelled therethrough by a fluid (gas or liquid) pressure gradient within the pipe. Pressure acting on one end of the pig body 4 causes expansion of the pig against the internal surface of the pipe, so that the teeth 12 are caused to scrape the interior surface of the pipe to dislodge material therefrom. Although it is not shown in FIG. 1, the outer diameter of the pig is normally equal to or slightly larger than the interior diameter of the pipe, so that the outer surface of the pig body 4 is forced against the internal surface of the pipe. As they become worn, the heads 19 of the teeth 12 can be replaced. The plates 21 and 22 resist removal of the teeth 12 from the body 4, and prevent driving of the head 19 into the body 4.

Because the body 4 of the pig is symmetrical, the pig can be caused to reciprocate in a pipe for removing scale from an area with large accumulations. In cases where the pig is used to separate different materials in a pipeline, the teeth 12 can be omitted.

I CLAIM:

1. A pig for use in a pipeline comprising onepiece, elongated, flexible, cylindrical body means; a plurality of annular rib means integral with said body means; longitudinal rib means integral with said body means extending between adjacent said annular rib means and defining recesses with said annular rib means; and tooth means extending out of said body means in each said recess, said tooth means and said rib means simultaneously engaging the interior of a pipeline when the pig is moved through the pipeline by a pressure differential in the pipeline.

2. A pig according to claim 1, wherein said tooth means includes internally threaded anchor means for mounting in said body means; externally threaded shank means for removable mounting in said anchor means; and head means on said shank means for engaging the interior surface of a pipeline when the pig is moved therethrough.

3. A pig according to claim 2, wherein said anchor means includes internally threaded sleeve means; bottom plate means for anchoring the sleeve means in said body means; and top plate means for limiting movement of the shrink means into the sleeve means and into the body means.

4. A pig according to claim 1, including finger means integral with said body means extending longitudinally from the annular rib means nearest each end of said body means towards such end.

5. A pig according to claim 4, wherein said finger means taper outwardly from said annular rib means towards the nearest end of the body means.

* * * * *